US007069670B1

(12) United States Patent
Gerke

(10) Patent No.: US 7,069,670 B1
(45) Date of Patent: Jul. 4, 2006

(54) PROTECTIVE FOOT WEAR

(76) Inventor: William P. Gerke, P.O. Box 767, Hallettsville, TX (US) 77964

( * ) Notice: Subject to any disclaimer, the term of this patent is extended or adjusted under 35 U.S.C. 154(b) by 196 days.

(21) Appl. No.: 10/886,488

(22) Filed: Jul. 7, 2004

Related U.S. Application Data

(60) Provisional application No. 60/487,927, filed on Jul. 17, 2003.

(51) Int. Cl.
*A41D 17/00* (2006.01)

(52) U.S. Cl. ..... 36/2 R; 36/109; 36/45; 36/132; 2/22

(58) Field of Classification Search ..... 36/1.5, 36/2 R, 71, 45, 55, 72 R, 109, 132; 2/22
See application file for complete search history.

(56) References Cited

U.S. PATENT DOCUMENTS

| | | | | | |
|---|---|---|---|---|---|
| 800,761 | A | * | 10/1905 | Parkman | 36/1.5 |
| 1,019,810 | A | * | 3/1912 | Lesselbaum | 36/2 R |
| 1,272,366 | A | * | 7/1918 | Bowman | 36/2 R |
| 4,001,953 | A | * | 1/1977 | Fugere et al. | 36/2 R |
| 4,117,609 | A | | 10/1978 | Helt | 36/4 |
| 4,306,315 | A | * | 12/1981 | Castiglia | 2/22 |
| 4,342,278 | A | | 8/1982 | Horan | 114/345 |
| 4,542,597 | A | * | 9/1985 | Baptista et al. | 36/2 R |
| 4,748,749 | A | * | 6/1988 | Colvard | 36/2 R |
| 4,756,026 | A | * | 7/1988 | Pierce, Jr. | 2/16 |
| 4,783,911 | A | | 11/1988 | Brown | 36/115 |
| 4,896,437 | A | * | 1/1990 | Johnson | 36/1.5 |
| 4,912,860 | A | | 4/1990 | Keller | 36/4 |
| 5,022,096 | A | | 6/1991 | Pacanowsky | 2/227 |
| 5,067,260 | A | | 11/1991 | Jenkins, Jr. | 36/7.1 R |
| 5,090,057 | A | | 2/1992 | Aldridge | 2/82 |
| RE34,662 | E | | 7/1994 | Keller | 2/82 |
| 5,454,744 | A | | 10/1995 | Seiler | 441/109 |
| 5,724,680 | A | | 3/1998 | Cesnick et al. | 2/239 |
| 5,943,695 | A | * | 8/1999 | Yen | 2/22 |
| 6,058,505 | A | * | 5/2000 | Bettencourt | 2/24 |
| 6,077,139 | A | | 6/2000 | Celik | 441/64 |
| 6,185,752 | B1 | * | 2/2001 | Hendersen et al. | 2/242 |
| 2002/0120977 | A1 | * | 9/2002 | Smith | 2/242 |

* cited by examiner

*Primary Examiner*—Marie Patterson
(74) *Attorney, Agent, or Firm*—Kenneth H. Johnson

(57) ABSTRACT

Protective foot wear having a shoe body, an elastomeric inner body, which has a sock portion and a sleeve, the sock portion being position in and attached to said shoe body. The sleeve extends from said shoe body. A shield is attached to the sleeve and the shield is sized to releaseably enclose the sleeve.

13 Claims, 5 Drawing Sheets

PROTECTIVE FOOT WEAR

This application claims the benefit of provisional application 60/487,927 filed Jul. 17, 2003.

BACKGROUND OF THE INVENTION

1. Field of the Invention

The present invention relates to protective foot wear, particularly a boot which is equipped with rigid plates protecting the foot and lower leg. One environment in which the present protective foot wear is used is wade fishing.

2. Related Information

Outdoor field sports participants are often faced with hazardous conditions, resulting from creatures and physical environment. In wade fishing this is particularly true. In most coastal waters a constant danger to the wade fisherman is the stingray, which although non aggressive is provoked to protective action when trod upon by the hapless wader. Many have felt the lash of a ray's tail which requires medical attention. Since the rays and other likely attackers are mainly bottom dwellers the protection required is for the foot and lower leg, i.e., the calf area.

Animals are not the only source of concern to a wader. Natural and manmade objects submerged in murky waters near the bottom is also a potential for causing injury.

SUMMARY OF THE INVENTION

Briefly, the present invention relates to protective foot wear comprising a shoe body, an inner body, preferably being an elastomeric material, having a sock portion and a sleeve, said sock portion being position in and attached to said shoe body, said sleeve extending from said shoe body and a shield attached to said sleeve, said shield being of a size to releaseably enclose said sleeve.

In a preferred embodiment, the present protective foot wear comprises: a shoe component comprising a polymeric sole and upper; an inner elastomeric member having a foot portion and a leg portion, said foot portion being attached in said shoe component and preferable conforming thereto; and an outer leg portion comprising a belt having a plurality of pockets therein, corresponding to said leg portion and attached thereto, each of said pockets containing a rigid member, said belt preferable having fasteners to close said belt around said leg portion.

DETAILED DESCRIPTION

The present protective foot wear is not only useful in water but in any utilization where protection of the lower leg is desirable, such as working or hunting in areas having high populations of poisonous snakes.

Figure 1:
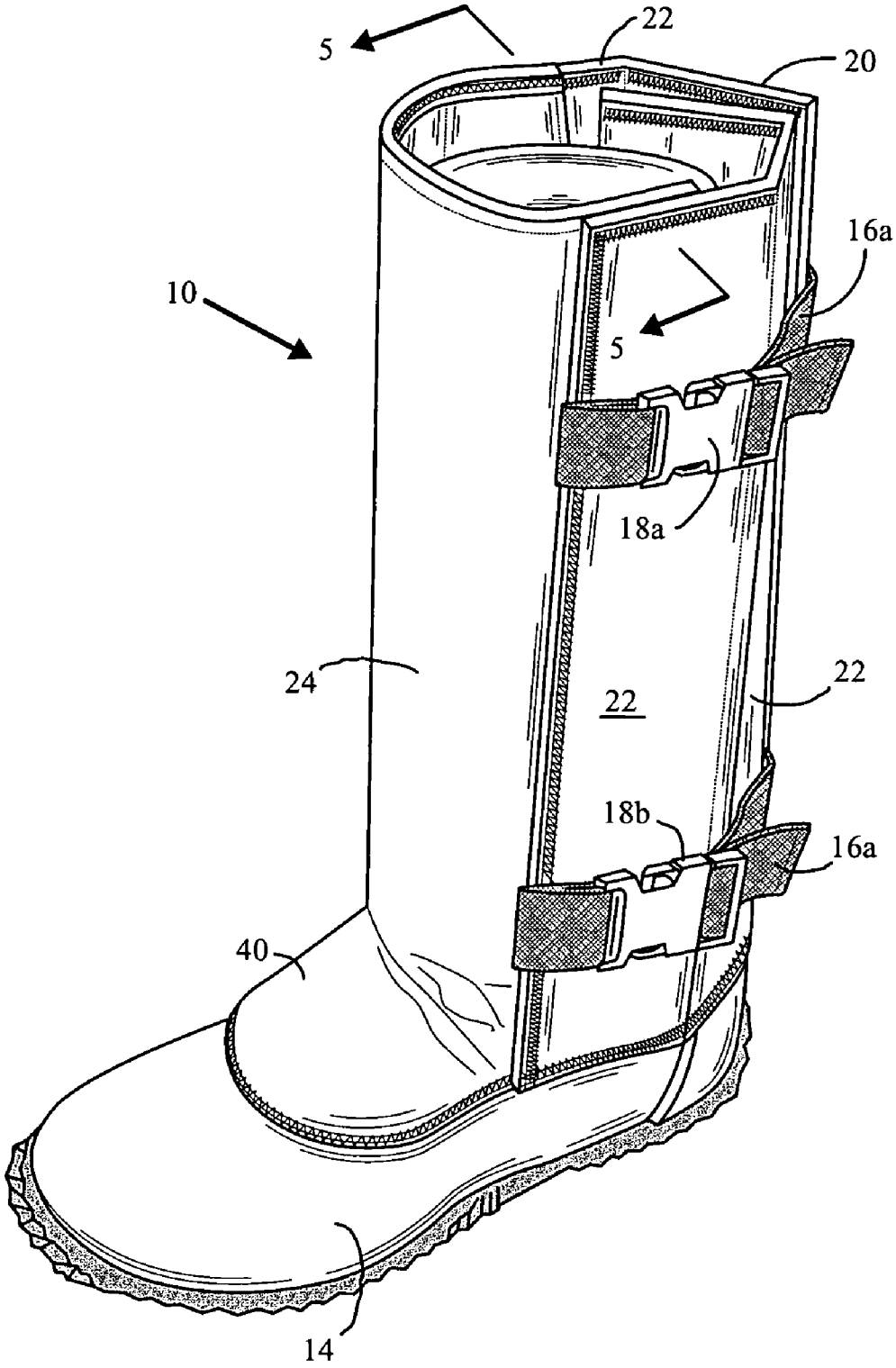
FIG. 1 is an isometric view of a left boot embodiment of the protective foot wear of the present invention.
Figure 2:
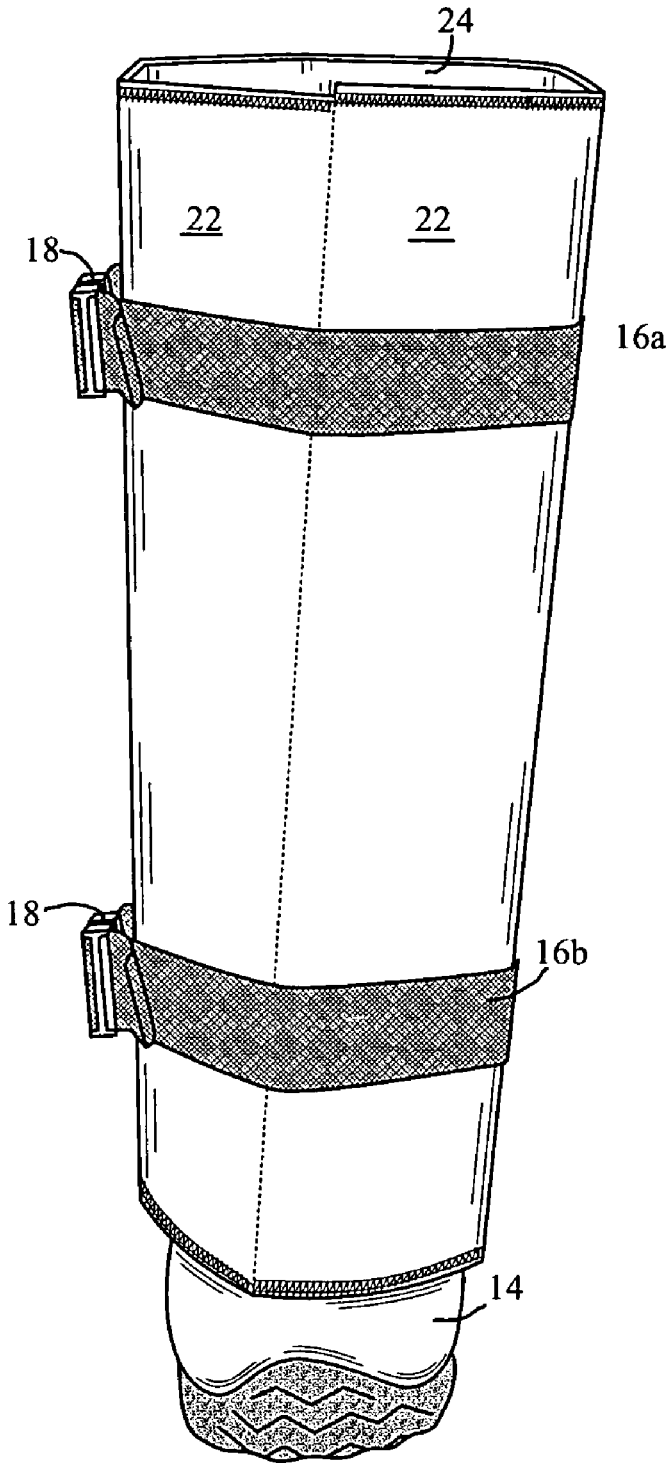
FIG. 2 is a rear elevation view of the boot of FIG. 1 in the closed configuration.
Figure 3:
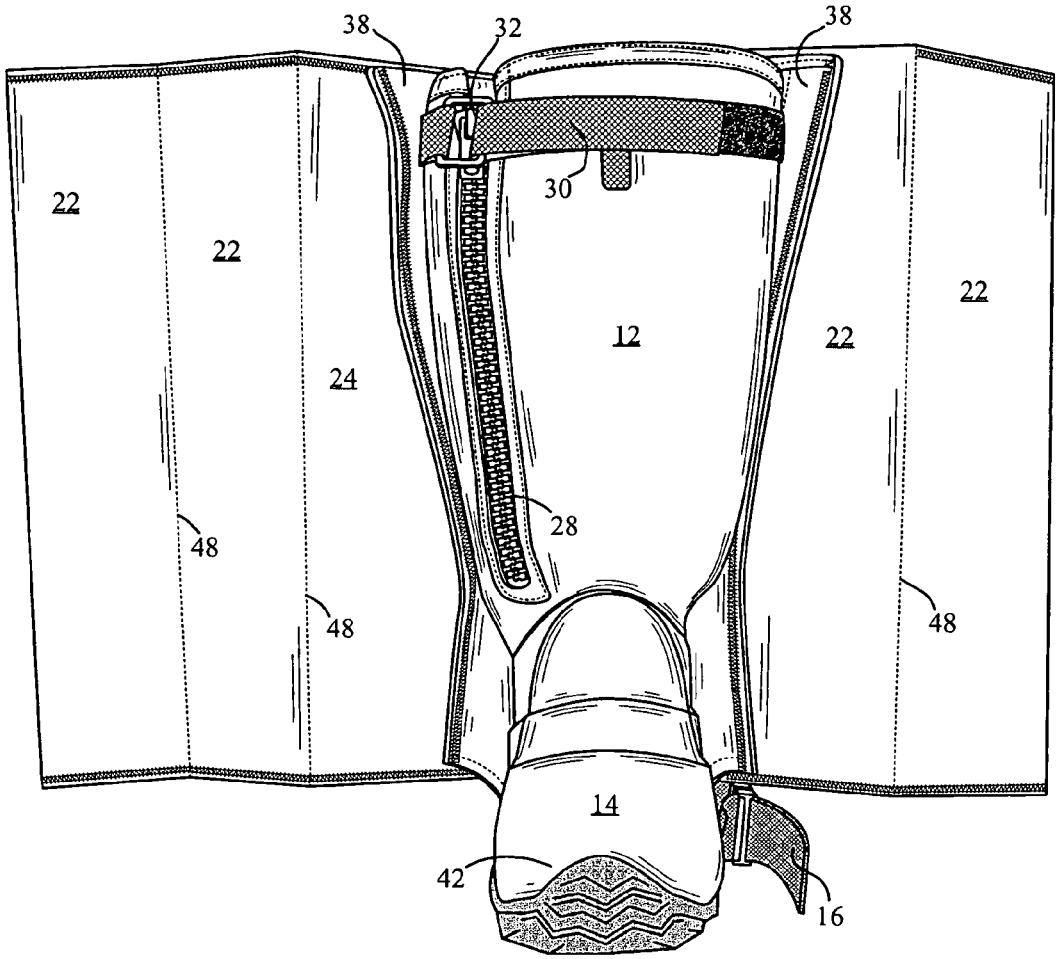
FIG. 3 is a rear elevation view of the boot of FIG. 1 having the protective shield open.

Referring to FIG. 1 the boot 10 is shown in its closed "for use" configuration. The boot comprises an inner body 12 and a shoe body 14.

Figure 4:
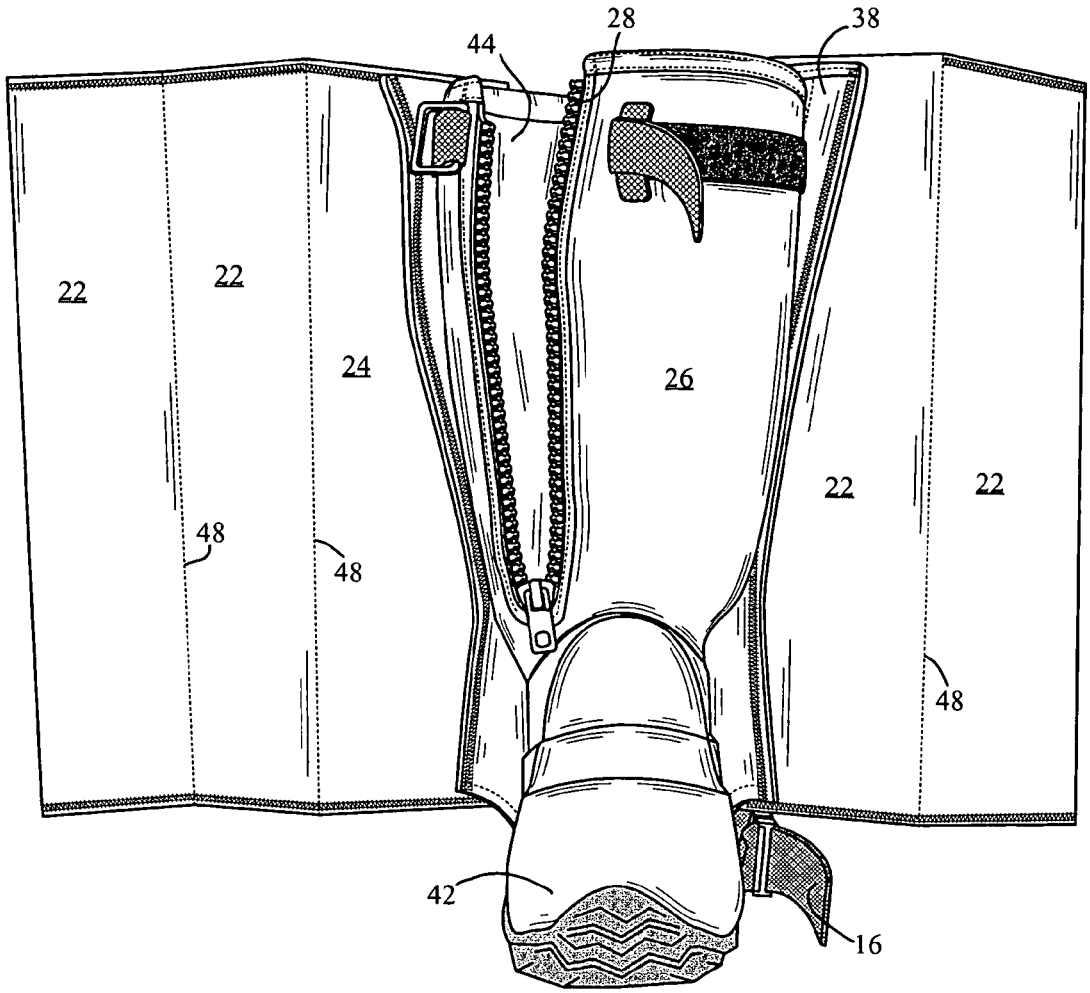
FIG. 4 is a rear elevation view of the boot of FIG. 1 having the protective shield open.

The shoe body is preferably made of a tough puncture-resistant material such as a high impact polymer or rubber. The inner body 12 comprises sock portion 5 which in FIG. 4 is shown to be within and confirmed to the shoe body 14 and a sleeve 26 which extends upward from the shoe body 14.

The inner body 12 may be a waterproof material, however, it preferably is elastomeric material having insulating properties, such as Neoprene of the type used in wet suits or the like. The sock portion 26 is glued or sealed into the shoe body 14. The sleeve 26 is provided with a zipper 28 which allows the sleeve to open for insertion of a human foot. Situated behind the zipper and attached to the sleeve about the zipper is an expansion flap 44, which maintains the integrity of the sleeve around the zipper when the zipper is opened or closed and allows expansion of the sleeve when the foot is inserted such that the sleeve is intact even when the zipper is opened. When the zipper 28 is closed the excess material in the expansion flap folds against the calf of the wearer. Since the expansion flap is preferably made of the same flexible insulating material as the sleeve, it improves the tightness of the sleeve against the calf.

The shield 20 preferably comprises a flexible belt having four vertical panels 22, a vertical front panel 24 and an instep panel 40. The shield is formed by placing rigid sheets such as plastic or metal into pockets along the belt to form a substantially continuous rigid shield. The belt may be cloth, such as nylon, polyester, fiberglass or the like. The pockets may be formed by sewing, gluing or fusing, in the case of polymeric materials, along the desired seams. The belt may also be made of sheet of porous or non porous polymeric materials having vertical pockets formed therein. The shield may also comprise a single sheet of rigid material in a single pocket (not shown) or a flexible sheet of high density material (not shown).

In the preferred embodiment shown the shield comprising four vertical panels 22, the vertical front panel 24 and is attached to the sleeve 26 of inner body 12 by shield extensions 38 by sewing. The attachment of the shield extension with the flaps 38 positions the front panel 24 adjacent to the instep of the shoe body 14. An instep panel 40 (also within the belt) extends from the front panel of the shield over the vulnerable instep area of the foot to provide additional protection.

The shield 20 panels extend around the sleeve 26 and downward over a portion of the shoe body 14. The overlapping of the shield components with the shoe body provides double protection to the ankle area and heel 42 of the foot in addition to the instep. The double protection in the ankle/instep region of the boot provides protection against animal attack (snakes and stingrays) and underwater objects where they are most likely to occur and do the most damage to a person.

Panel inserts, positioned in heavy nylon belts are a preferred embodiment because it requires less effort for a person to close the panels (rather than a single sheet of rigid plastic) about the sleeve and to attach the upper buckle 18*a* and lower buckle 18*b* to form an enclosed armored wall around the calf area of a wearer (not shown). Each insert on the belt is arrayed as closely as possible to its adjacent insert(s), with only the seam on the pocket(s) separating the insets, thereby forming a substantially continuous shield about the sleeve 26.

Each buckle 18*a* and 18*b* is attached to belt component 16*a* and 16*b* respectively. The preferred buckles shown comprise an interlocking component on each opposed belt component for quick attachment and release and are available commercially. Any means (such as snaps, clips, conventional loop belts and the like) to fasten the shield 20 about the sleeve 26 may be employed. The belt is preferably woven, for example, from nylon or saltwater resistant polymeric material.

A sleeve strap 30 with buckle 32 is provided adjacently to the upper terminus of the sleeve 26 to tighten the sleeve on the calf of the wearer (not shown).

Figure 5:
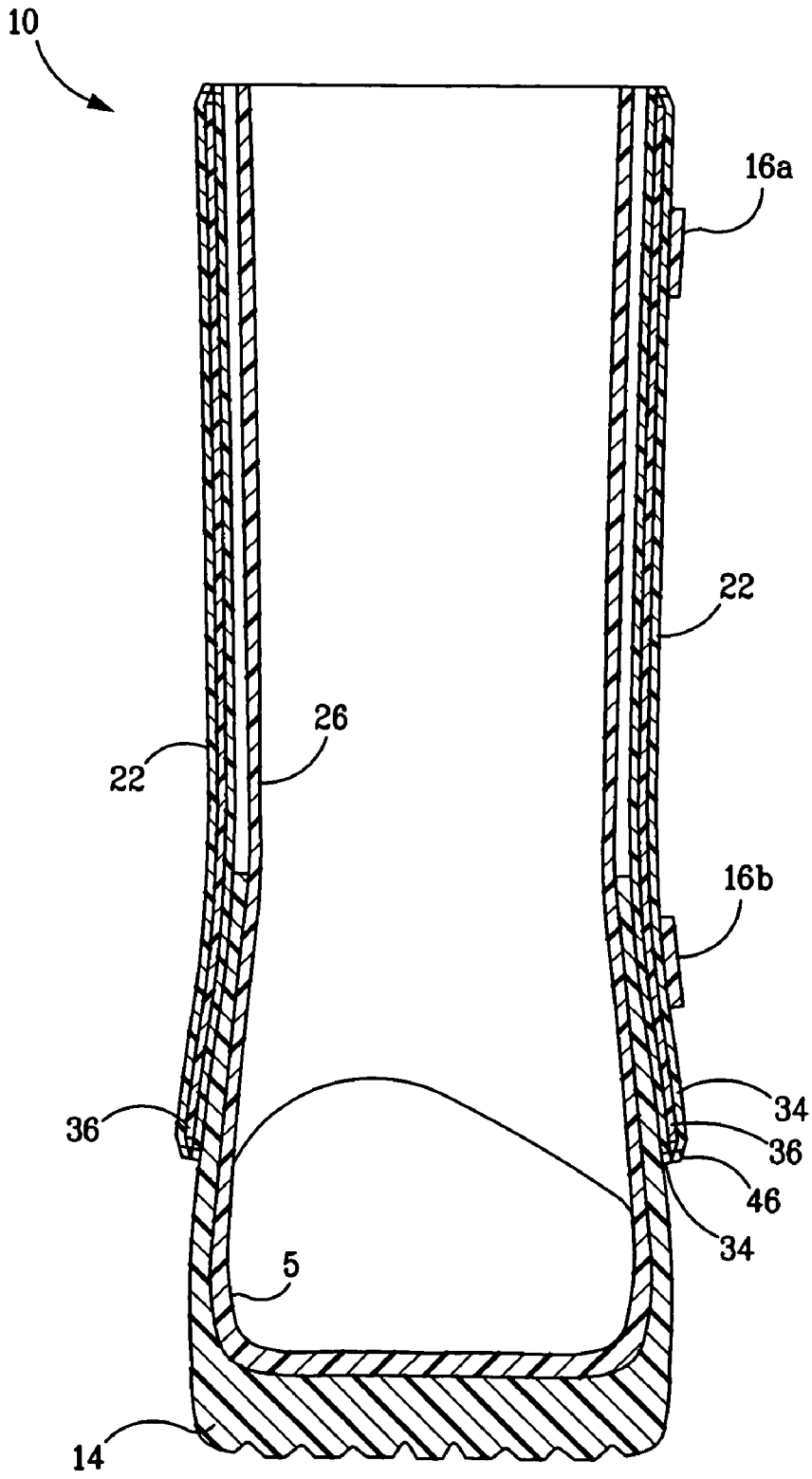
FIG. 5 is cross sectional view taken along line 5—5 of FIG. 1.

Referring to FIG. 5, the construction of the boot 10 is illustrated. The inserts 36 are shown positioned with a pocket formed by cloth sheets 34*a* and 34*b* and closed at both ends by stitches 46. The sock portion 5 of the inner body 12 is seated in the shoe body 14 and adhered therein (not shown). Preferably, the shoe body extends to cover the ankle of the wearer (not shown) and provides the additional overlap protection and support noted above.

The invention claimed is:

1. Protective foot wear comprising a shoe body, an elastomeric inner body having a sock portion and a sleeve, said sock portion being position in and attached to said shoe body, said sleeve extending from said shoe body and a shield attached to said sleeve, said shield being of a size to releaseably enclose said sleeve.

2. The protective foot wear according to claim 1 wherein said shield comprises a plurality of rigid panels arrayed along a belt.

3. The protective foot wear according to claim 2 wherein said panels are laterally arrayed.

4. The protective foot wear according to claim 2 wherein said panels are arrayed to form a substantially continuous rigid shield.

5. The protective foot wear according to claim 2 wherein said belt comprises pockets having rigid panel members therein.

6. The protective foot wear according to claim 5 wherein said panel members comprise plastic material.

7. The protective foot wear according to claim 5 wherein said panel members comprise metal.

8. The protective foot wear according to claim 1 wherein said sleeve has a closeable vertical opening therein.

9. Protective foot wear comprising:

a foot component comprising a polymeric sole and upper;

an inner elastomeric member having a foot portion and a leg portion, said foot portion being attached in said foot component an outer leg portion comprising a belt having a plurality of pockets therein, corresponding to said leg portion and attached thereto, each of said pockets containing a rigid member.

10. The protective foot wear according to claim 9 wherein said belt has fasteners to close said belt around said leg portion.

11. The protective foot wear according to claim 10 wherein said leg portion has a slit extending distally from said foot portion and a zipper positioned along said slit.

12. The protective foot wear according to claim 9 wherein a pocket containing a rigid member extends from said belt over an area corresponding to the instep of the shoe component.

13. The protective foot wear according to claim 10 wherein adjacent rigid members are positioned as closely possible together, whereby said belt and panels provide a substantially continuous shield to fasten around said leg portion.

* * * * *